US006368294B2

(12) United States Patent
Quinn

(10) Patent No.: US 6,368,294 B2
(45) Date of Patent: Apr. 9, 2002

(54) MASSAGING SURFACE

(76) Inventor: Gregory Quinn, 8001 Bay Pkwy., Brooklyn, NY (US) 11214

( * ) Notice: Subject to any disclaimer, the term of this patent is extended or adjusted under 35 U.S.C. 154(b) by 0 days.

(21) Appl. No.: 09/754,576

(22) Filed: Jan. 5, 2001

Related U.S. Application Data

(63) Continuation-in-part of application No. 09/256,385, filed on Feb. 24, 1999, now Pat. No. 6,174,298.

(51) Int. Cl.[7] ..... A61H 7/00

(52) U.S. Cl. ..... 601/137; 601/136

(58) Field of Search ..... 601/107, 122, 601/124–125, 128–129, 131, 134–137; D24/214

(56) References Cited

U.S. PATENT DOCUMENTS 5,018,511 A 5/1991 Yokoi

FOREIGN PATENT DOCUMENTS

| | | | |
|---|---|---|---|
| FR | 533487 | 3/1922 | ..... 601/123 |
| GB | 442105 | 2/1936 | |

*Primary Examiner*—Justine R. Yu
(74) *Attorney, Agent, or Firm*—Boris Leschinsky

(57) ABSTRACT

A massaging surface contains alternating rows of massaging elements, each element includes three resilient arms extending radially and upwardly in symmetry from a common base point on that surface and terminating in massaging balls for delivering long stroke massage when pressed against a skin of a patient. The massaging surface allows for administering uniform massage over a large area including longitudinal and rotational strokes due to overlapping of massaging areas of individual adjacent massaging elements.

10 Claims, 3 Drawing Sheets

MASSAGING SURFACE

CROSS-REFERENCE DATA

This application is a continuation-in-part of the patent application Ser. No. 09/256,385 now U.S. Pat. No. 6,174,298 entitled MASSAGING ELEMENT AND A PORTABLE MASSAGER USING SAME filed Feb. 24, 1999 and incorporated herein by reference in its entirety.

BACKGROUND OF THE INVENTION

1. Field of the Invention

The present invention relates generally to devices to induce a massaging motion over a certain area of a patient's body. In particular, the device of the present invention relates to back massagers of the type capable of generating the long stroke massaging motions in a way similar to that given by a professional massage therapist. The massaging surface of the invention can be used as a part of many commonly known massaging devices.

2. Description of the Prior Art

The word "massage" is used in the context of this specification to generally describe a variety of motions over a patient's body such as rubbing over the skin, rumpling the muscles, slapping or rapping and pressing over various portions of the patient's body so as to eliminate venous congestion, to stimulate arterial circulation, and to intensify metabolism in various tissues. Although a massage generally can be performed manually by another person, various devices have been described in the prior art that would be either of assistance to the person performing a massage or allow the patient to induce a massage onto himself without the help of others. Specifically, such devices have been proposed for the massage of the patient's back. They typically incorporate some form of a massaging element, which is designed to induce the massage by transforming a massaging motion generated by the device onto a patient's skin. In many cases, each massaging device incorporates a plurality of massaging elements in which case they form in combination a massaging surface to cover a portion of the patient's skin.

The area of the patient's back presents a special interest for a massaging therapy. Complains of a "back pain", especially in the lumbar region, are quite common. In fact, in some cases they can cause severe pains and even become debilitating. It is believed that periodic applications of a massaging therapy can stimulate more blood flow in these areas and therefore relieve these symptoms. On the other hand, as opposed to other portions of the body, the back is difficult to reach for the patient himself Therefore, there is a need for either professional assistance or an apparatus allowing the patient to apply a massage to the back of the body.

A large variety of massagers and massaging devices have been proposed for these purposes. They generally can be divided into two groups. The first one consists of small hand-held devices inducing high frequency vibrations over a limited area of the skin. Although inexpensive and portable, these devices do not allow for a deep massage of the tissue such as what can be given by a professional massage therapist. The second group consists of rather complex back massage devices typically incorporated in a piece of furniture such as a chair or a bed.

Three patents of the prior art are believed to be the closest to the present invention. A massaging device described in the French patent No. 533,487 issued in March of 1922 describes a variety of massaging elements including in particular a device consisting of two rigid arms connected together on one end with a flat leaf spring while the other end of each arm contains a free rotating massaging roller. In application, a compression of the device against a portion of the skin leads to movement of the rollers away from each other thus compressing the skin. Return motion is supported by the action of the leaf spring. Upon close examination, one can easily see a number of substantial limitations of this invention, namely, that only a small portion of the skin can be massaged with this device. To cover a larger area, one has to move it many times from place to place. Also, and perhaps even more importantly, the area between the rollers is not covered by a massaging action at all. The presence of this "dead zone" is characteristic to many massaging devices of the prior art.

An improvement of that device is described in a British patent No. GB 442,105 issued in February of 1936. This device contains a plurality of paired massaging elements similar to the previously mentioned French invention. The advantage of this device is that a larger portion of the skin can be covered all at once. At the same time, the presence of the same "dead zone" limits the utility of the device. Also, the massaging motion of all the elements is oriented in the same direction, while it is believed that the best massaging effect can be achieved by applying massaging motion in various directions over the same area of the skin.

Finally, Yokoi suggests a version of the chair massager attachment in the U.S. Pat. No. 5,018,511. Elongated plate members having massaging protrusions with optional leaf springs are described in this U.S. patent as the basis of the massaging apparatus. Reciprocating movements of the plate members cause high frequency vibrational massage to be applied to the patient's back or other portions of the body held against the apparatus. This apparatus does not have provisions for a deep long stroke massage of the patient's back wherein the massaging protrusions can move slowly along a substantial portion of the skin rather then frequently hitting a limited area of the skin. In addition, this device is quite large and can not be easily folded for storage.

An important limitation of the above mentioned and many other massaging devices of the prior art is that they are only capable of delivering a longitudinal type of massaging motion. It is highly desirable to provide at least some rotational massaging motion along with longitudinal one.

The need therefore exists for a simple massaging surface allowing for a long stroke deep skin massage, especially over the patient's back. An apparatus incorporating such massaging surface should be capable of delivering a uniform massage over a large area of the skin without any "dead zones".

SUMMARY OF THE INVENTION

Accordingly, it is an object of the present invention to overcome these and other drawbacks of the prior art by providing a novel massaging surface for delivering a long stroke massage.

Another object of the invention is to provide a massaging surface for delivering massage to large portions of the skin all at the same time.

A further object of the invention is to provide a massaging surface for delivering massage uniformly and without "dead zones".

A further yet object of the invention is to provide a massaging surface for delivering both longitudinal and rotational massaging motions.

The massaging surface of the invention is principally illustrated on FIG. 1 and is envisioned to be used either as a stand alone massaging mat or as a part of a massaging apparatus. In case of using the massaging surface as a massaging mat, the patient can press the portion of the skin against the mat or vise versa. Alternately, another person can use such mat to press against the patient skin. If part of an apparatus, the surface can be mechanically pressed against the patient by such apparatus.

The massaging surface of the present invention consists of multiple alternating rows of triple arm massaging elements. Each element in turn contains three compressible arms extending radially and upwardly from a common base at the plane of the surface. Radial direction of each arm is offset from the next arm by 120 degrees which makes all three arms symmetrical about the point of their common base. Upward direction of each arm is designed to be at an angle to the plane of the surface ranging between about 35 and 75 degrees. Each arm is made of a leaf spring and terminated with a rounded ball or another commonly know massaging tip adapted to gently compress the skin. Alternating placement of the massaging elements along the massaging surface allows for overlapping the massaging area of each element so that "dead zones" are eliminated. Once the element is pressed against the skin, each massaging ball at the end of each arm is compressed against the skin so that the arm is bent and deflected and the ball is moved away from the base point. Because of the overlapping of the massaging areas of each massaging element, two adjacent balls from neighboring elements are moving towards and sideways to each other. That complex motion creates rotational component of the massage while preventing any "dead zones" from forming. A plurality of such massaging elements provide in combination a long stroke massage close to that of a manual nature. Resilient design of the arms returns the balls in their initial position upon removing the massaging surface away from the skin.

All of the above mentioned and other objects and features of the invention are illustrated on the drawings and described in greater detail below.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE INVENTION

A detailed description of the present invention follows with reference to accompanying drawings in which like elements are indicated by like reference letters and numerals.

Figure 1:
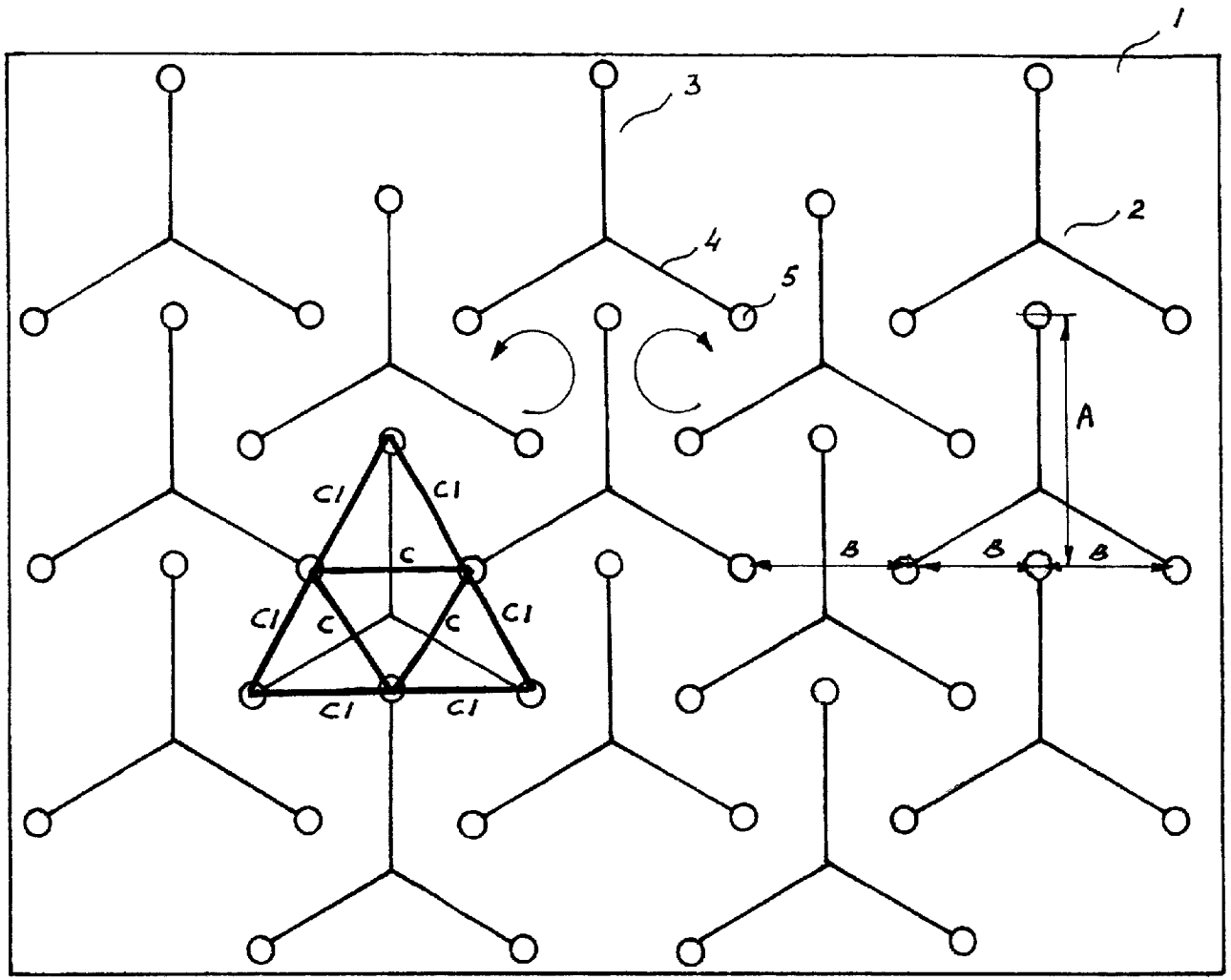
FIG. 1 is the schematic top view representation of the principle behind the massaging surface of the present invention.

FIG. 1 illustrates a massaging surface which contains a base surface (1) made from any appropriate rigid or preferably flexible material such as rubber, leather, fabric, or polymer. Triple arm massaging elements (2) are placed on surface (1) in alternating rows. Each massaging element (2) contains a set of three resilient arms (3). Each arm (3) is extending from a common base point radially and upwardly. Radial direction of each arm is offset from the next arm by 120 degrees which make all three arms positioned symmetrically about the point of their common base. Upward direction forms an angle with the surface (1) ranging from about 35 to 75 degrees and preferably from about 45 to 60 degrees. The length of each arm can range between about ½ and 3 inches. Each arm (3) in turn consists of a spring rod (4) extending from a base (6) and terminating with a massaging ball (5). Other rounded massaging tips can also be used to terminate the rod (4) so that atraumatic tip is formed and gentle compression of the skin can be achieved. The rod (4) is made of a resilient spring material such as a leaf spring made of appropriate metal or polymer. A protective layer of plastic may optionally cover it. In its lower end, each rod (4) is placed in a base (6), all three bases (6) extending from the same common base point on the surface (1). The size of massaging ball can range from about ⅛ of an inch to about 1 inch in diameter depending on the application. In case of a massaging mat for a car seat for example, it is preferred to use larger size balls (5) and stiffer rods (4) while for softer back skin massage smaller size massaging balls are advantageous. For average universal applications, ½ inch massaging balls may be used.

Placement of each of the massaging element (2) on the surface (1) is critical for the success of the invention. Orientation of all massaging balls (5) of each element (2) is the same. For the purpose of further explanation and as shown on FIG. 1, each ball in a set of three massaging balls (5) of every massaging element (2) is designated as TOP, LEFT, and RIGHT. The following is a description of the principles governing the locations of massaging elements (2):

all massaging elements (2) are placed only in alternating vertical rows and oriented the same way;

all corresponding TOP, LEFT, and RIGHT massaging balls (5) are placed in vertical rows with the same vertical distance "A" between respective TOP balls. Same is true between respective LEFT balls (5) and separately between respective RIGHT balls (5). Distance "A" may preferably range between ¾ and 4 inches;

in each vertical row, the TOP ball of one massaging element is positioned in line with and in the middle between the LEFT and RIGHT ball of the above massaging element at a distance "B" preferably ranging from about ½ to 4 inches;

each LEFT and RIGHT ball of one massaging element forms a horizontal row with respective LEFT and RIGHT massaging ball of the second vertical row over to the right and to the left of that massaging element. The distance between the respective LEFT ball of one vertical row and RIGHT ball of the second vertical row over is also "B";

each vertical row is shifted against the next one by such a distance that the distance between a common base of one massaging element and the closest three massaging balls from surrounding massaging elements is the same and is designated as "C" preferably ranging from about ¼ to 4 inches;

the distance between each LEFT ball of one massaging element (2) to the closest TOP and RIGHT balls of the next massaging element (2) to the left of that first element is the same and is designated as "C1". All three balls form a straight line. Same is true for the RIGHT ball of each massaging element (2);

"C" equals "C1".

The entire massaging surface (1) may be assembled from individual elements as described above. Alternately, it may be molded or otherwise produced as a single component from an appropriate polymer material such as polyurethane, polyethylene, or nylon.

Figure 2:
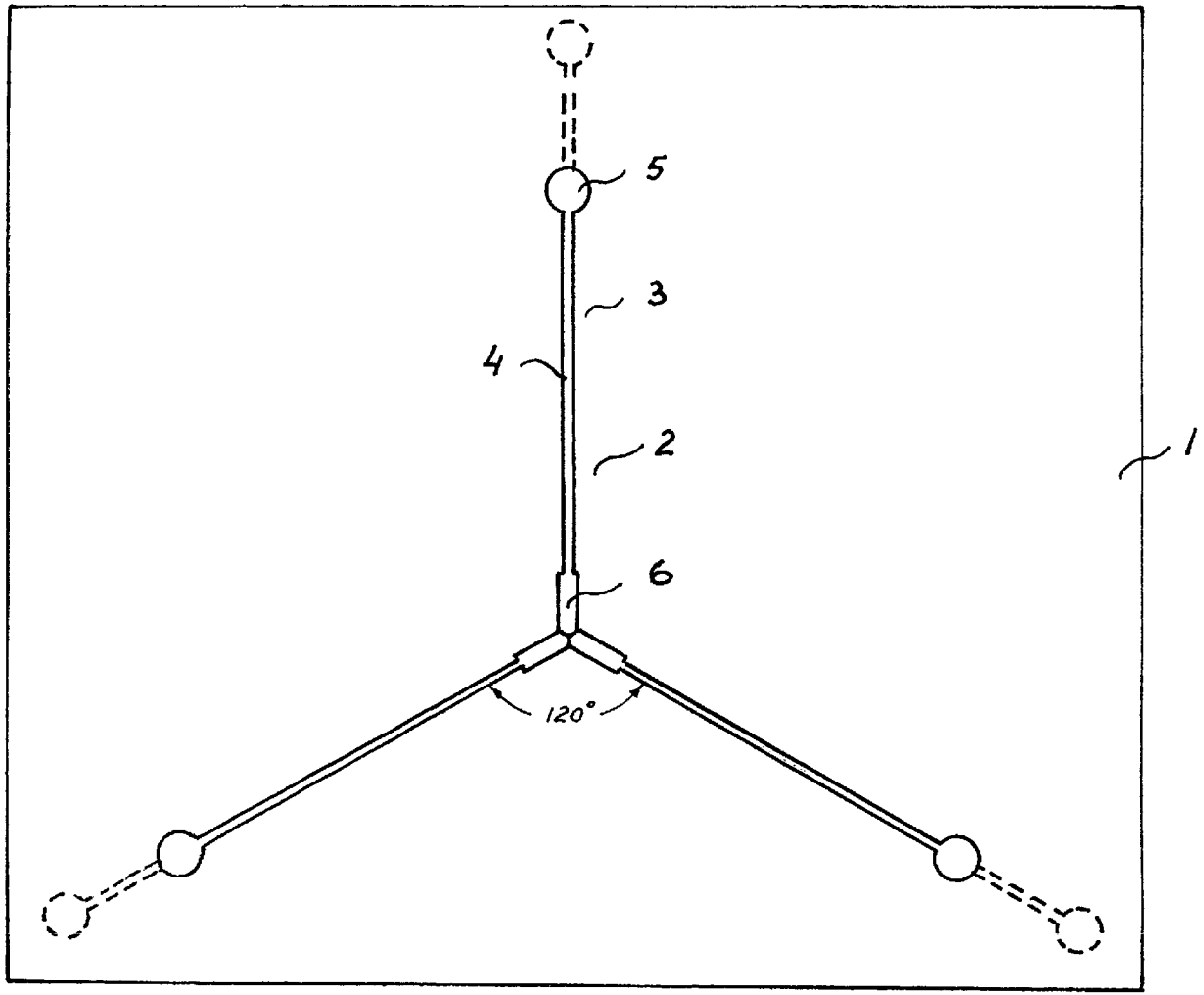
FIG. 2 is an enlarged top view of a massaging element of the massaging surface of the invention—solid lines illustrate the position of the arms before compression and dashed lines illustrate the position of the arms after compression; and finally
Figure 3:
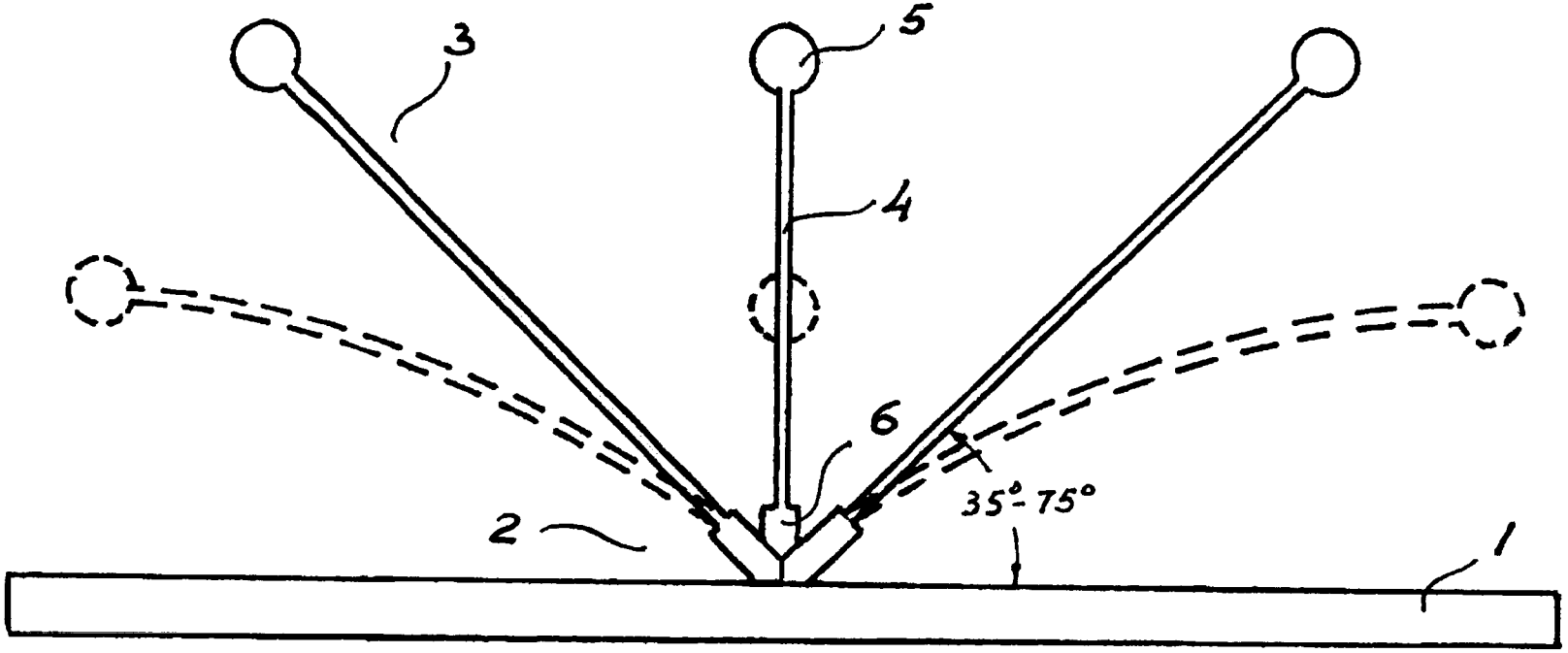
FIG. 3 is an enlarged side view of the same as in FIG. 2.

In use, the massaging surface (2) is brought in close contact with the skin of the patient by either compressing it against the skin or alternately pressing the skin against the surface (2). The direction of that action is assumed to be generally perpendicular to the plane of the surface (2). At that point, all massaging balls (5) of each massaging element (2) are forcefully sliding against the skin of the patient (therefore delivering massage) and away from the common base point as well as from each other. Resilient rods (4) are bent and therefore further compress the balls (5) against the skin. FIGS. 2 and 3 illustrate the position of the massaging elements (2) before compression (solid lines) and being fully compressed (dashed lines).

In addition to its linear motion away from the common base of each massaging element (2), the massaging balls of the adjacent elements (2) interact with each other and with the area of the skin in their vicinity. Rotational motion results from this interaction as shown by circular arrows on FIG. 1. Therefore, a combined longitudinal and rotational long stroke massage is delivered over a wide area of the skin all at the same time. Removing of the massaging surface (1) away from the skin relaxes the rods (4) and brings all the massaging balls (5) back to their initial position shown on FIG. 1. The cycle then can be repeated many times to deliver continuous uniform massage. Periodic movement of the surface along the skin may be advantageous to deliver massage to other parts of the body.

The massaging surface of the invention can be widely used in a variety of products such as massaging mats, massaging inserts for chairs, car seats, and alike, as well as a part of medical and general purpose massaging devices.

Although the present invention has been described with respect to a specific embodiment and application, it is not limited thereto. One useful variation is a massaging surface utilizing a number of larger size massaging balls and corresponding larger extending arms in combination with smaller size massaging elements placed between the larger ones. Other numerous variations and modifications readily will be appreciated by those skilled in the art and are intended to be included within the scope of the present invention, which is recited in the following claims.

I claim:

1. A massaging surface for delivering a long stroke massage comprising a base surface and a plurality of massaging elements positioned on said base surface, each massaging element comprising three resilient arms with atraumatic tips, said arms extending radially and upwardly from a common base point on said base surface, each massaging element when compressed overlaps the area of the adjacent compressed massaging element.

2. The massaging surface as in claim 1, wherein an atraumatic tip comprises a massaging ball.

3. The massaging surface as in claim 2 wherein said massaging balls being about ½ inch in diameter.

4. The massaging surface as in claim 1, wherein each arm of the massaging element forms a 120 degree angle in a radial direction with the other arms of the same massaging element.

5. The massaging surface as in claim 1, wherein each of said arms extends upwardly from said base surface at an angle ranging from about 35 to 75 degrees.

6. The massaging surface as in claim 1, wherein each arm comprises a resilient rod, said rod having a first end and a second end, said rod extending at said first end from a base positioned at said common base point, said arm further comprising a massaging tip placed on the second end of said rod.

7. The massaging surface as in claim 1, wherein said massaging elements are positioned in alternating rows.

8. The massaging surface as in claim 7, wherein each of said rows contains massaging elements spaced apart equally and oriented the same way.

9. The massaging surface as in claim 8, wherein the common base point of any of said massaging elements is located at equal distances from closest arms of all adjacent massaging elements.

10. The massaging surface as in claim 1, wherein said base surface is flexible.

* * * * *